US005676622A

United States Patent [19]

McFarlane

[11] Patent Number: 5,676,622

[45] Date of Patent: Oct. 14, 1997

[54] WRIST EXCERCISER

[76] Inventor: Pamela McFarlane, 48 Imperial, Ventura, Calif. 93004

[21] Appl. No.: 622,653

[22] Filed: Mar. 26, 1996

[51] Int. Cl.[6] ..... A63B 23/14

[52] U.S. Cl. ..... 482/45; 482/109; 273/109; 446/267; 446/489

[58] Field of Search ..... 482/45, 46, 92, 482/93, 82, 105, 108, 148, 109; 273/109, 110, 112, 457; 446/489, 267

[56] References Cited

U.S. PATENT DOCUMENTS

| | | | |
|---|---|---|---|
| 2,752,725 | 7/1956 | Unsworth | 273/109 X |
| 3,490,766 | 1/1970 | Gardner | 482/105 |
| 4,647,037 | 3/1987 | Donohue | 482/82 |
| 4,778,173 | 10/1988 | Joutras | 482/82 |
| 5,139,472 | 8/1992 | Caruthers | 482/93 |
| 5,281,192 | 1/1994 | Nelson | 482/93 |
| 5,380,261 | 1/1995 | Mora | 482/46 |

OTHER PUBLICATIONS

"Jux-A-Cisor" Sammons 1994 Catalog.

*Primary Examiner*—Richard J. Apley
*Assistant Examiner*—John Mulcahy

[57] ABSTRACT

A wrist therapy device comprises a handle, a maze mounted to one end of the handle, an object for following the maze, and a weight mounted to the handle between the handle and the maze. The user grasps the handle and moves the wrist to manipulate the maze so as to move the object along the maze. The maze may be a bent wire and the object a ring encircling the wire. Alternatively, the maze may be a bent tube filled with a viscous fluid and the object a ball within the tube.

14 Claims, 4 Drawing Sheets

WRIST EXCERCISER

BACKGROUND OF THE INVENTION

1. Field of the Invention

The present invention relates generally to the field of exercise devices, and more particularly to a device constructed to provide therapeutic results to specific muscles, joints and tendons in the wrist area, by dramatically increasing the range of motion of the wrist. The muscles and tendons that control this joint, would be able to work efficiently.

The wrist is the foundation of all movements of the hand, fingers, thumb and forearm, needed for the use of the upper extremeties. Many persons suffer from malignancies to the wrist. These malignancies may be the result of injuries, including repetitive action injuries, diseases, arthritis or strokes.

These malignancies result in a reduced capacity to utilize the hand in an efficient manner. The wrist may be severely limited in its allowed range of motion, so that a person may only be able to move their hand a few degrees in any direction. It is difficult for persons with this malignancy to perform such vital activities such as self-feeding, personal hygiene, working or driving. In addition many simple activities such as playing board games with the family are close to impossible to participate in since the grasping and moving of objects is difficult and painful.

Many athletes require the benefits of improved control and additional strength to the wrist muscles, tendons, and joints. These athletes depend upon their abilities to succeed in their chosen endeavors.

Both groups of individuals must rely on therapeutic devices to provide the type of physical training necessary to overcome deficiencies. The person handicapped with a wrist malignancy must increase the range of motion allowed as well as regain competent control over the hand. Athletes must increase their range of motion and strength, to achieve peak performance during sporting events.

Several basic steps are necessary to alleviate wrist malignancies, including increasing the circulation of blood to the effected areas. This is achieved by increasing the range of motion through which the wrist can move. The increased range allows the cardiovascular muscles to stretch and supply the area with an increased amount of oxygen enriched blood, improving circulation.

When the range of motion is increased, it will be necessary for the patient to begin strengthening the weakened muscles and increase coordination. The primary muscles involved are the flexor carpi ulnaris, flexor carpi radialus, extensor carpi ulnaris, extensor carpi radialus, longus and brevis, and the palmaris longus. In addition secondary muscles must benefit from any exercise device. These secondary muscles include the flexor digitorum superficialis, flexor digitorum profundius, flexor policus longus, extensor digitorum commurius, extensor policis longus, extensor policis brevis, and the abductor policis.

The surrounding ligaments must be stretched as well as the muscles to insure an increase in the range of motion of the wrist. The ligaments are the intercarpal ligaments, the extensor retonaculum, volar facia, and the triangular fibro cartlige complex.

Many times when the wrist has been incapacitated by a wrist malignancy the elbow may be affected as well, insofar as the elbow may acquire a limited amount of motion due to the disuse of the wrist.

No matter what the cause of the wrist malignancy may be, it is desirable by individuals with this problem to attempt to alleviate the situation through physical therapy. This device, when used in exercising of the wrist, will allow the patient an increased range of motion, assisting in returning it to its pre-treatment level, returning the ligaments and tendons back to there pre-injured stage. Physical/Occupational therapists today employ numerous mechanisms in an attempt to solve their patients wrist malignancies. These devices are generally small weights which the patient grasps in their hand and attempts to move utilizing the wrist muscles. This tends to be undisciplined movement and can cause further damage to the primary, and secondary muscles as will as the ligaments by over extending the injured muscles and ligaments.

Other means of therapy employed include hot baths, applying heat, or a hot packs to the wrist, increasing the circulation of blood and allowing the ligaments and tendons to stretch and elongate, this is only temporary as the vessels, ligaments, and tendons will begin to constrict as the surrounding muscle tissue cools.

2. Description of the Prior Art

Many inventors have addressed the strengthening of muscles in general, with the wrist as a target area for strengthening. Attempts have included twisting devices such as U.S. Pat. No. 5,380,261 to Mora which describes a device which includes a cylindrical member with a weight attached by use of a cord. The cylindrical member is turned by the patient, which in turn lifts the weight. Increased weights are used to increase the level of difficulty, or therapeutic activity. This device tends to provide exercise in only set of muscles and in only one direction. In addition it does not provide for increased range of motion in any direction other then the direction of turning, and this increase in motion is very limited due to the amount of distance necessary to turn the member.

Hand held devices have been developed, such as U.S. Pat. No. 5,281,192 to Nelson which describes a movable weight on a shaft which projects from a curved member which is bisected laterally by an adjustable handle. The patient grasps the handle and moves the device in a direction perpendicular to the ground. This in turn strengthens the forearm and hand muscles. The wrist muscles are strengthened as well, however the positions in which the device is held and the motions through which it is moved do not provide any increase in the range of motion through which the wrist may move.

Additional hand held devices cradle the hand, such as U.S. Pat. No. 5,346,450 to Caruthers and U.S. Pat. No 5,139,472 to Caruthers. These patents describe spherical weights with an internal area constructed to fit the hand. This compartment keeps the hand in a particular position relative to the weight and to the arm. The purpose is to keep the hand, wrist, and forearm muscle in a precise arrangement so as to provide greater training to specific arm muscles, such as a bisep. These devices do not provide for any wrist development, and range of motion to the wrist is confined by the device housing.

The current state of the art in the field of therapeutic equipment has not produced a device capable of increasing the range of motion to a persons joints.

OBJECTS AND ADVANTAGES

It will be apparent from the foregoing that there exists a need for a therapeutic device through which a person may increase the range of motion their wrist moves through and at the same time strengthens the persons wrist related muscles.

Accordingly it is a general object of this invention to provide an improved wrist therapy device.

It is a further object of this invention to provide a wrist therapy device which will increase the range of motion of the users wrist and associated muscles and ligaments.

It is a additional object of this invention to provide a wrist therapy device which will supply controlled motion of the wrist during use of the device.

It is another object of this invention to provide a wrist therapy device which will increase the circulation of blood to the wrist area.

It is an additional objective of this invention to provide a wrist therapy device which will increase the strength of the users muscles associated with the wrist.

It is a still further objective of this invention to provide a wrist therapy device which will produce a higher level of coordination in the use of the wrist and associated muscles.

These and other objects, features, and advantages of the present invention will become apparent from the following detailed descriptions of the preferred embodiments that are to be read conjunction with the accompanying drawing.

SUMMARY OF THE INVENTION

The present invention resides in device which will increase the range of motion of the wrist, as well as provide strength and increased coordination of the wrist and its muscles and ligaments in addition to increasing the circulation of blood to the wrist area.

The device being utilizable by persons of varying ages, sizes and capacities.

The preferred embodiment of the invention consists of a tube which is to grasped by the user. At the end of the tube held by the thumb and forefinger is a flange. This flange is provided with a male threaded post. This post is the receptacle to various attachments. Weights of varying sizes may be attached to this end depending upon the users abilities. These weights in turn have a female threaded receptacle on one end a male threaded post upon the other end. These weights may be attached to one another to create a variety of weigh totals.

Whether the weights are attached or not the end result will be a male threaded post protruding from the assembly. Onto this is attached a cap upon which is welded a twisted wire maze. The wire is welded in such a way that both ends of the wire are attached to the cap. Conversely the two ends of the wire maze may be pressed into two mating holes in the face of the cap and secured by a thumbscrew. On the wire is a slideable element such as a washer which can be negotiated from one side of the wire maze to the other.

The patient will utilize differing wire mazes, depending upon the individuals needs and abilities. Patients with very a limited range of motion will require a wire maze with large looping sections which would require a limited amount of motion. A wire maze with short sections and tight corners will cause the patient to exert greater effort and precision in the articulation of the wrist muscles and ligaments.

The users forearm is secured in place to a table using a hook and loop, or other fastening device. The user then grasps the device and by moving only the wrist translates the washer from one side of the wire maze to the other as prescribed. This in turn forces the user to move and bend their wrist through numerous twists and turns. This motion causes the primary and secondary muscles to expand and contract in particular pattern, depending on the form of the wire maze. This expanding and contracting works to loosen tight and atrophied muscles. The ligaments am stretched as the wrist moves and turns. Blood vessels in the wrist and surrounding tissue are stretched as well, making them more pliant. This pliancy allows the blood vessels to move an increased amount of blood to the wrist area. As more blood is supplied to the muscles in the wrist they gain nutrients which allow the muscles to perform at increased levels. This in turns allows for greater range of motion and the cycle is repeated.

Hand/eye coordination is developed by the user as the washer negotiates the maze.

The weights are of varied sizes and are screwed onto the handle and subsequently the cap is screwed onto the weight. The weights are attached as the user gains proficiency in the use of the device. After the range of motion of the wrist, or the wrist/elbow combination is increased it is desirable to increase the strength of all of the associated muscles. Moving the washer throughout the maze insures that all of the primary and secondary muscles are used.

When, instead of the forearm, the users bicep is secured with the hook and loop fastener, the use of the device will increase the range of motion of the wrist muscles and ligaments, as well as the elbow muscles and ligaments. Coordination between the elbow and the wrist is developed when the two work together to move the washer as well as increased strength when the weights are employed.

In a subsequent embodiment the wire maze would be replaced with a hollow tube which would be filled with viscous fluid. Into this fluid would be place a metal ball. The user would move the ball from one end of the tube to the other. The viscous fluid would ensure that the ball moved a slow rate which would encourage greater motion and longer times where certain muscles would be used.

An additional embodiment would construct the handle so that the weights would be placed internally.

Further embodiments would alter the methods of construction and assembly to include press on weights, or handing weights.

DESCRIPTION OF THE PREFERRED EMBODIMENTS

The first embodiment is described with reference to FIGS. 1–7

Figure 1:
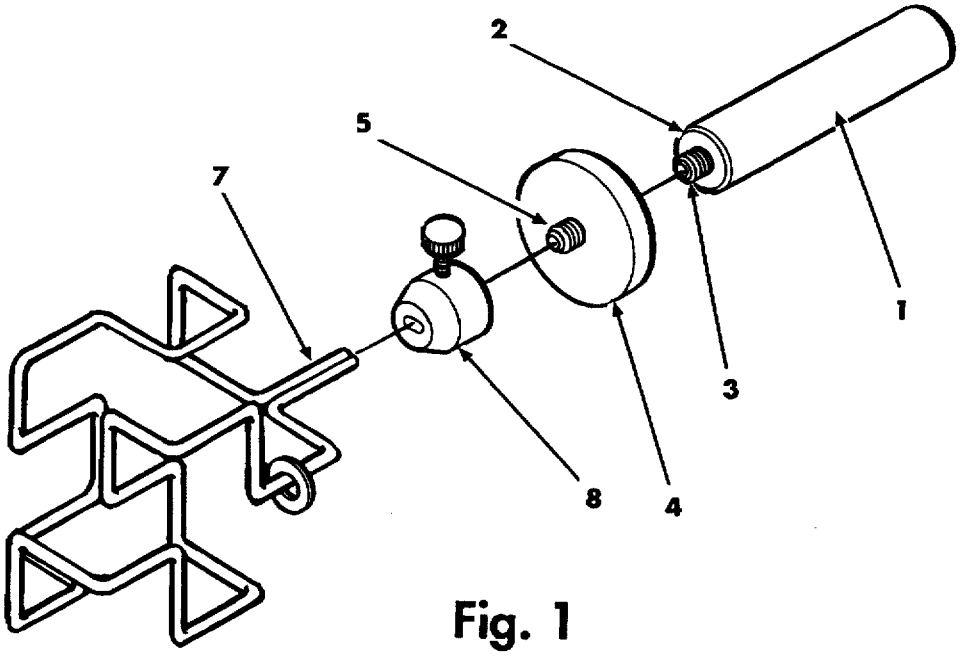
FIG. 1 is a perspective exploded view of invention.

In accordance with the invention as shown in FIG. 1 a device is constructed with a tube shaped handle 1 which is terminated with a flange 2 upon which is a threaded post 3.

Figure 2:
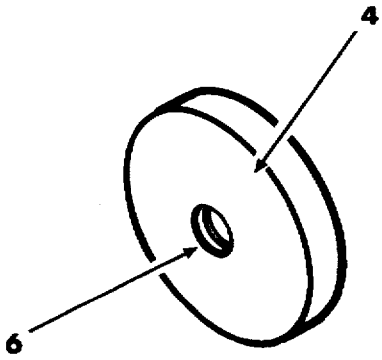
FIG. 2 is a perspective view of the rear of a weight.

Weights 4 are provided with male threaded post 5 as shown in FIG. 1 and female threads 6 as shown in FIG. 2. These weights 4 are of various weights and may be interchanged or added to provide sufficient weight to the user.

Figure 3:
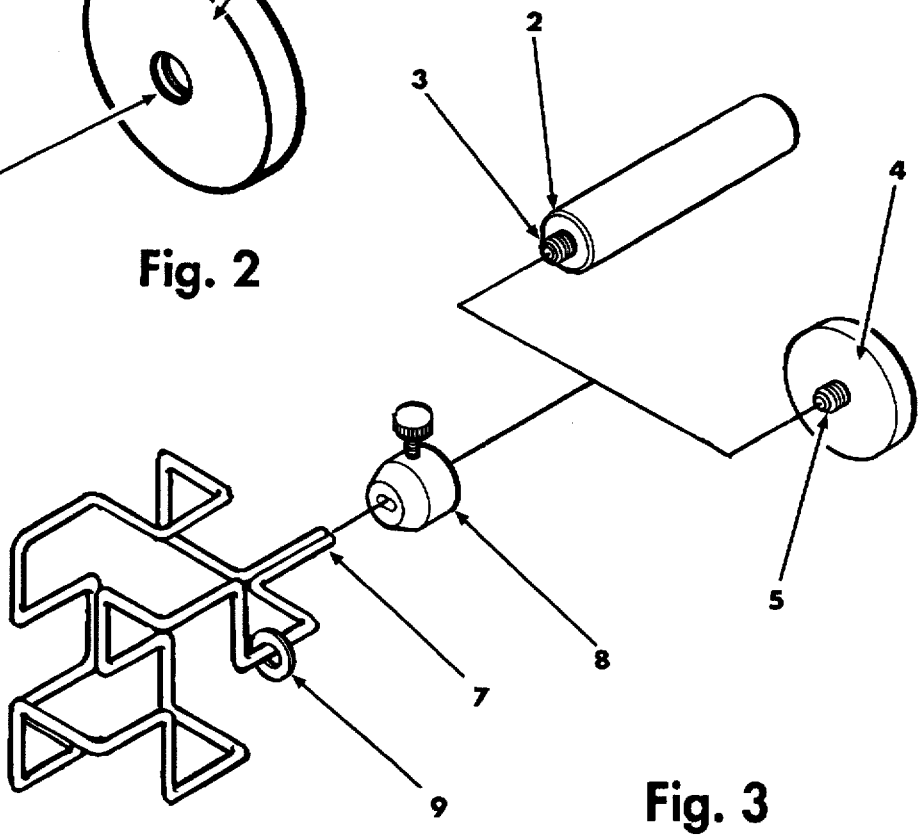
FIG. 3 is a perspective view of the wire maze.
Figure 4:
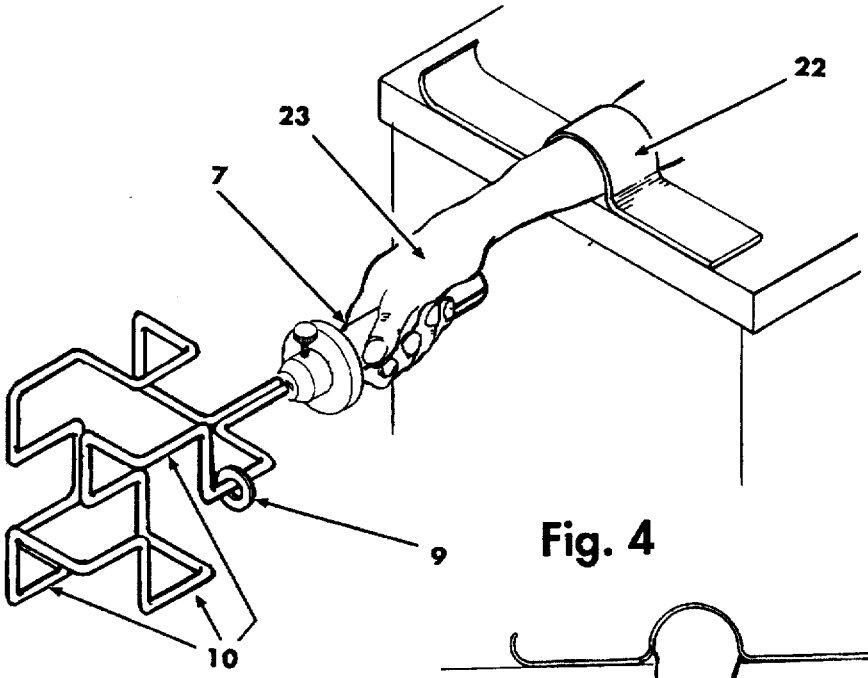
FIG. 4 is a perspective view of a user grasping the assembled device.

The wire maze 7, as shown in FIG. 3, is attached to a cap 8 which is provided with female threads which attach to either the male threaded post 5 on the weights 4 or the male threaded post 3 on the handle flange 2. A slideable object 9 is engaged to the wire maze 7. The arm of the user 22 is restrained so that only the wrist 23 is movable as shown in FIG. 4. The user grasps the handle 1 and twists and turns the handle 1 forcing the slideable object 9 to move along segments 10 of the wire maze 7.

Figure 5:
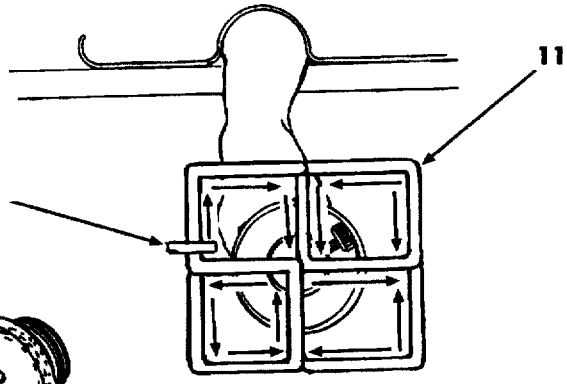
FIG. 5 is a table of the motions the wire frame induces upon the user.
Figure 6:
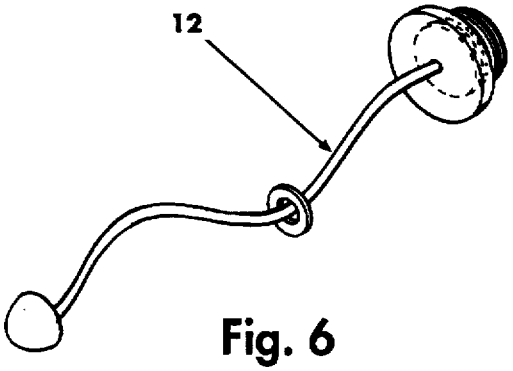
FIG. 6 is a perspective view of a simplified wire maze.
Figure 7:
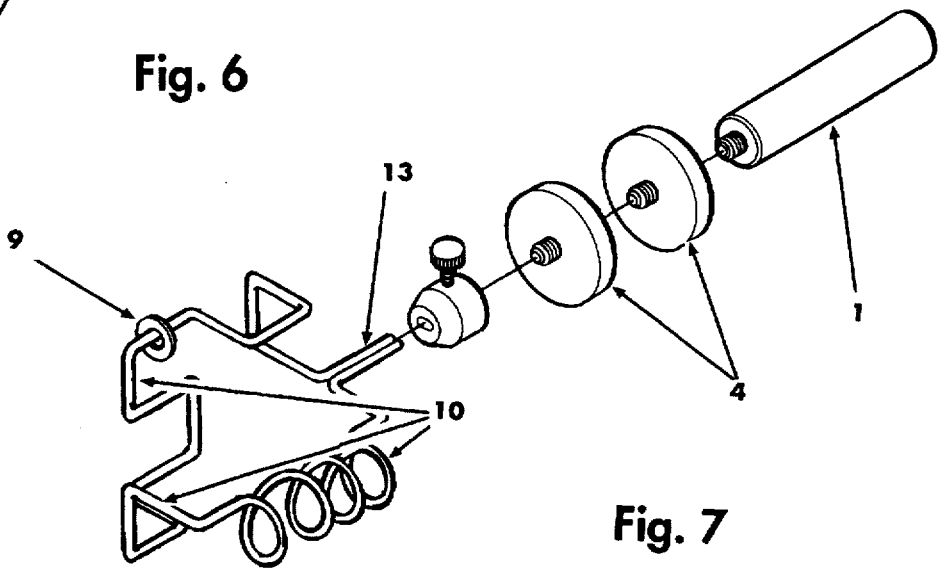
FIG. 7 is a perspective view of a complicated wire maze.

The motion necessary to advance the slideable object 9 is controlled by the shape of the wire maze 7. FIG. 5 shows the motions 11 necessary to move the slideable object through 6 segments 10 of the wire maze 7. The motions 11 required may be modified by using a wire maze 7 of differing designs. A simple wire maze 12 shown in FIG. 6 encourages small, beginner movements, while a complicated wire maze 13, as shown in FIG. 7, produces a vastly greater range of motion.

The addition of weights 4 to the handle 1 forces the user to use greater force to move the slideable object 9 from maze segment 10 to maze segment 10. This increases the strength of the muscles in the wrist.

ADDITIONAL EMBODIMENTS

Figure 8:
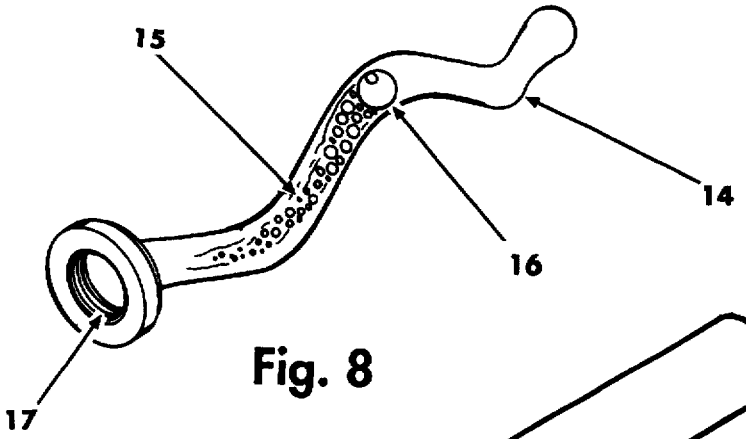
FIG. 8 is a perspective view of a fluid filled tube.

The first additional embodiment of the invention is described with reference to FIG. 8.

A bent tube 14 filled with a viscous fluid 15 takes the place of the wire maze 7. Inside of the tube a small metal ball 16 is placed within the viscous liquid 15. The tube 14 is provided with a female threaded area 17 which is attached to the male post 3 on the handle 1. The user moves the handle 1 in such a way as to move the ball 16 from one end of the tube 14 to the other end.

The viscous fluid 15 prevents the ball 16 from moving quickly and encourages the user to maintain a position for greater lengths of time.

Figure 9:
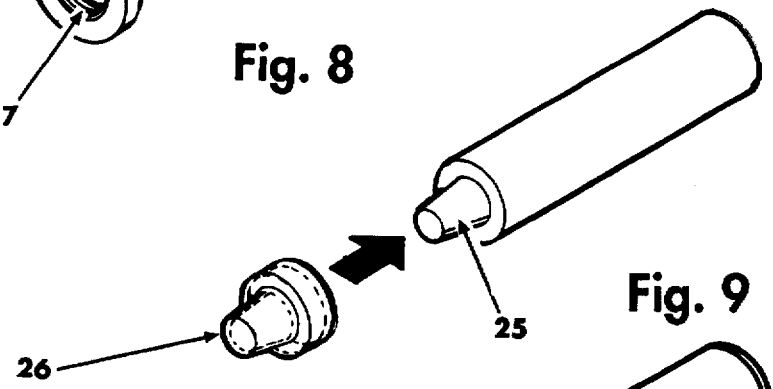
FIG. 9 is a perspective view of an alternative embodiment.

A further embodiment of the invention is described with reference to FIG. 9.

The handle 1 is provided with female threads 17 on its inside lower portion 18. Weights 19 with a male threaded post 20 are attachable to the handle 1 in such a way as to fit within a recess 21 on the bottom of the handle 1. This will provide for a greater degree of balance.

Further embodiment alters the methods of attachment of the weights 4 to the cap 8 and handle 1 are described with reference to FIGS. 10–12.

Figure 10:
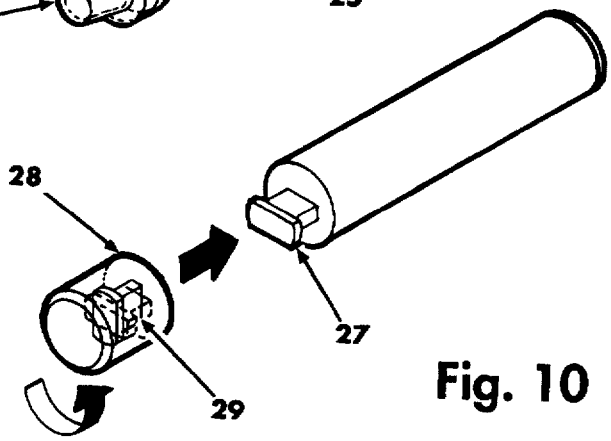
FIG. 10 is a perspective view of a press fit assembly.

A press together fitting 24 is shown in FIG. 10. The male post 25 and the female receptacle are constructed with tapered mating walls 26. The male post 25 is pushed onto the female receptacle 25 until the tapered mating walls 26 are pressed together to form a tight fit.

Figure 11:
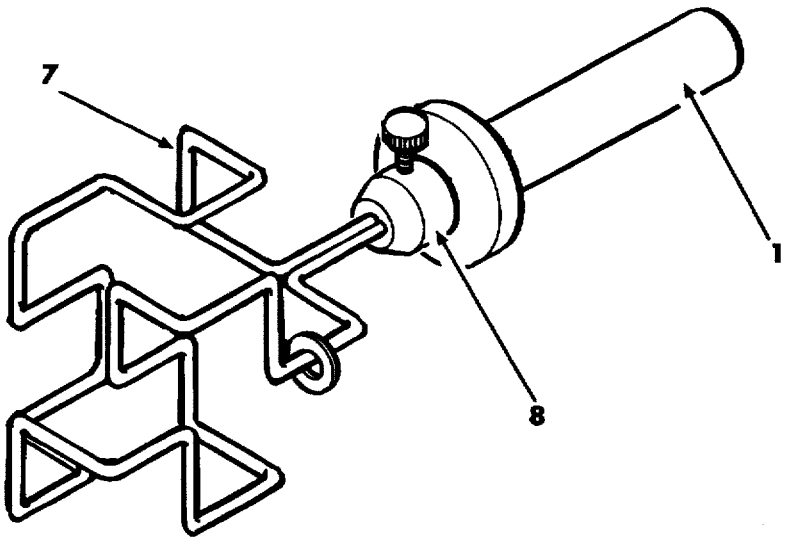
FIG. 11 is a perspective view of a quarter turn assembly.
Figure 8:
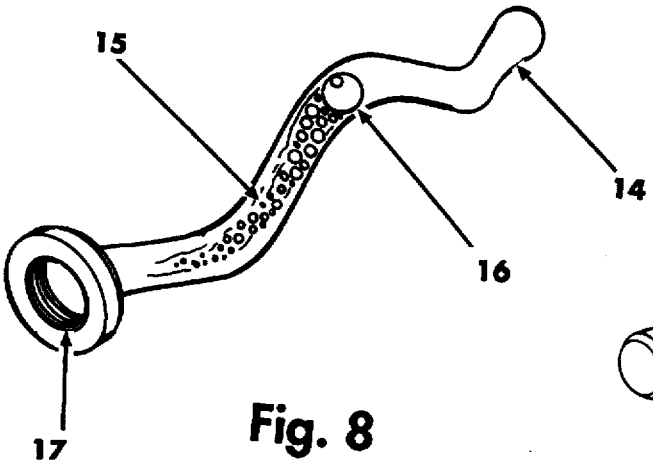
Figure 9:
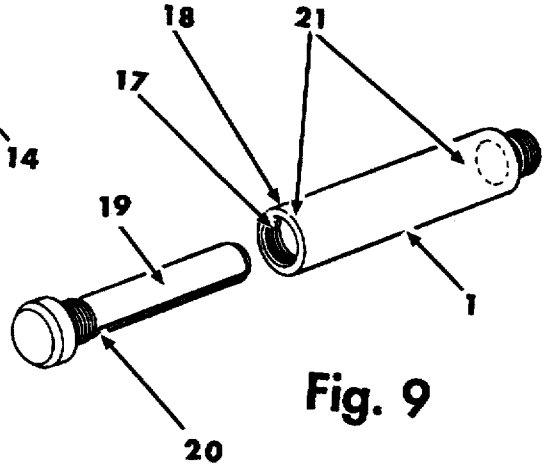
Figure 10:
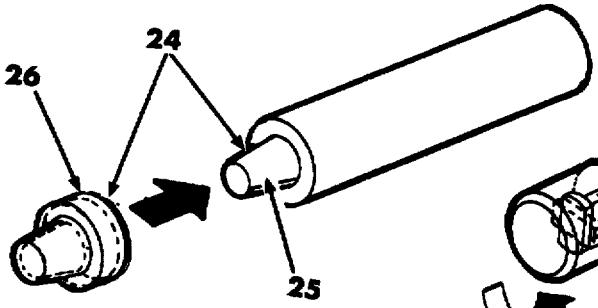
Figure 11:
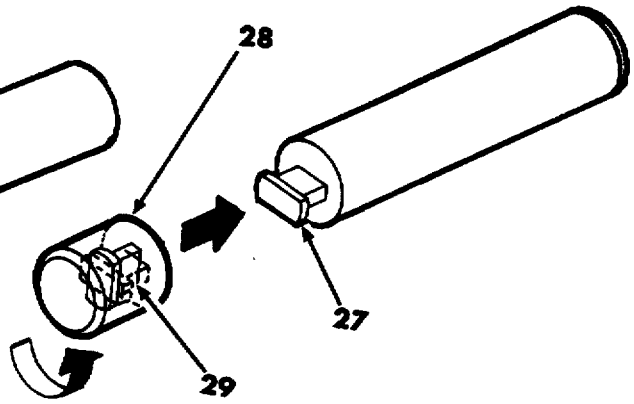

A quarter turn fitting is shown in FIG. 11. The male post 27 and the female receptacle 28 are formed with a partial thread 29. The male post 27 is placed into the female receptacle 28 and is twisted until the partial thread 29 engaged.

Figure 12:
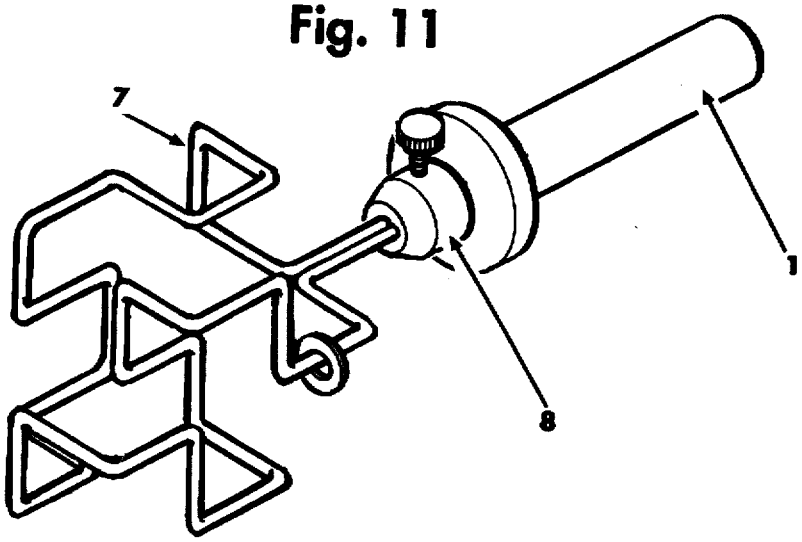
FIG. 12 is a perspective view of a one piece assembly.

A one piece assembly is shown in FIG. 12. The handle 1, cap 8 and maze 7 are constructed as one unit and may be made from injection molded materials.

CONCLUSIONS, RAMIFICATIONS, AND SCOPE

It will be appreciated from the foregoing description that the present invention represents a significant advance in the therapy of injured, deceased and improvement necessary wrist muscles, ligaments, and tendons. In particular it provides for a remedy and an improvement to the range of motion capabilities of persons with wrist afflictions and range of motion improvement needs. This is accomplished by forcing the wrist through a series of managed exercises coordinated by a semi random path.

In addition the present invention provides means to strengthen weaken wrist muscles.

Still further coordination and control of the wrist are greatly improved through use of the current invention.

It will also be appreciated that, although specific embodiments of the present invention have been described here for the purposes of illustration, various modifications may be made, such as a permanent table top mounting. In addition other alternatives are available such as a slideable object embodying magnetic qualities.

It will be further appreciated that the embodiments of the present invention described here for the purposes of illustration are descriptions of current therapeutic devices, additional human handicaps will call for further embodiments.

These and other embodiments are possible without parting from the spirit and scope of the present invention so that the scope of the present invention should be determined by the appended claims only.

I claim:

1. A wrist therapy device comprising:

a handle;

a maze;

means for mounting the maze to one end of the handle;

an object for following the maze;

a weight; and means for attaching the weight to the one end of the handle, between the handle and the maze.

2. The wrist therapy device of claim 1, wherein the maze is a wire maze and the object is configured to encircle the wire.

3. The wrist therapy device of claim 2, wherein the object is a ring encircling the wire.

4. The wrist therapy device of claim 1, wherein the maze is a tube and the object is within the tube.

5. The wrist therapy device of claim 4, wherein the object is a ball within the tube.

6. The wrist therapy device of claim 4, wherein the tube is filled with a fluid.

7. The wrist therapy device of claim 6, wherein the fluid is a viscous fluid.

8. The wrist therapy device of claim 1, wherein the mounting means comprises a press-together fitting.

9. The wrist therapy device of claim 1, wherein the mounting means comprises a twist-on fitting.

10. The wrist therapy device of claim 1, wherein the mounting means comprises a threaded fitting.

11. The wrist therapy device of claim 1, wherein the means for attaching the weight to the handle comprises a threaded fitting.

12. The wrist therapy device of claim 1, wherein the weight comprises a plurality of separate weights.

13. The wrist therapy device of claim 1, wherein the means for mounting the maze to the handle comprises the maze being mounted to the weight which is mounted to the handle.

14. The wrist therapy device of claim 13, wherein the mounting means and attaching means are complementary to allow the maze to be attached directly to the handle.

* * * * *